US007824503B2

(12) United States Patent
Maslow et al.

(10) Patent No.: US 7,824,503 B2
(45) Date of Patent: Nov. 2, 2010

(54) AQUEOUS HYDROGEN PEROXIDE-CONTAINING COMPOSITION AND ITS USE FOR CLEANING SURFACES

(75) Inventors: Wasil Maslow, Deventer (NL); René Gerritsen, Loosdrecht (NL); Bernhard De Vries, Hulshorst (NL); John Meijer, Deventer (NL); Paul Albert Iacobucci, St. Charles, IL (US)

(73) Assignee: Akzo Nobel N.V., Arnhem (NL)

( * ) Notice: Subject to any disclaimer, the term of this patent is extended or adjusted under 35 U.S.C. 154(b) by 0 days.

(21) Appl. No.: 12/296,894

(22) PCT Filed: Apr. 12, 2007

(86) PCT No.: PCT/EP2007/053540

§ 371 (c)(1),
(2), (4) Date: Oct. 22, 2008

(87) PCT Pub. No.: WO2007/118835

PCT Pub. Date: Oct. 25, 2007

(65) Prior Publication Data

US 2009/0264333 A1 Oct. 22, 2009

Related U.S. Application Data

(60) Provisional application No. 60/791,444, filed on Apr. 13, 2006.

(30) Foreign Application Priority Data

May 22, 2006 (EP) ..... 06114297

(51) Int. Cl.

| | |
|---|---|
| ***B08B 3/04*** | (2006.01) |
| ***C11D 3/22*** | (2006.01) |
| ***C11D 3/37*** | (2006.01) |
| ***C11D 3/39*** | (2006.01) |
| ***C11D 7/18*** | (2006.01) |

(52) U.S. Cl. ..... 134/25.2; 134/38; 134/39; 134/40; 134/41; 134/42; 510/238; 510/239; 510/240; 510/243; 510/253; 510/367; 510/375; 510/434; 510/473; 510/476; 510/477; 510/488

(58) Field of Classification Search ..... 510/238, 510/239, 240, 243, 253, 367, 375, 434, 473, 510/476, 477, 488; 424/25.2, 38, 39, 40, 424/41, 42

See application file for complete search history.

(56) References Cited

U.S. PATENT DOCUMENTS

| | | | | |
|---|---|---|---|---|
| 5,296,239 | A | 3/1994 | Colery et al. | |
| 5,349,083 | A | 9/1994 | Brougham et al. | |
| 6,656,897 | B1 * | 12/2003 | Cardola et al. | 510/239 |

FOREIGN PATENT DOCUMENTS

| | | | |
|---|---|---|---|
| AU | 2002100596 | | 11/2002 |
| EP | 1 001 011 | | 5/2000 |
| EP | 1001011 | * | 5/2000 |
| JP | 05 112798 | | 5/1993 |
| WO | WO 99/28427 | | 6/1999 |
| WO | WO 02/12431 | | 2/2002 |
| WO | WO 2004/020562 | | 3/2004 |
| WO | WO 2005/001162 | | 1/2005 |

OTHER PUBLICATIONS

European Search Report, EP Application No. 06 11 4297, dated Oct. 30, 2006.
International Search Report, PCT International Application No. PCT/EP2007/053540, dated Aug. 20, 2007.
Written Opinion of the International Searching Authority, PCT International Application No. PCT/EP2007/053540, dated Aug. 8, 2007.
Response to Written Opinion dated Feb. 13, 2008.
International Preliminary Report on Patentability, PCT International Application No. PCT/EP2007/053540, dated Apr. 20, 2008.

* cited by examiner

*Primary Examiner*—Brian P Mruk
(74) *Attorney, Agent, or Firm*—Kenyon & Kenyon LLP

(57) ABSTRACT

The invention pertains to an aqueous composition having a pH of 3 or less and comprising the following ingredients, based on the total weight of the composition: a) 0.05-40 wt % of a polymeric thickener having —COOR groups, wherein R is independently chosen from H, OH, and a carbon-containing group, and b) 0.05-60 wt % of hydrogen peroxide, wherein the active oxygen content attributable to ingredient a) is at least 0.02 wt %, based on the total weight of the composition, with the proviso that (co)polymers prepared from (meth)acrylate monomers are absent.

10 Claims, No Drawings

AQUEOUS HYDROGEN PEROXIDE-CONTAINING COMPOSITION AND ITS USE FOR CLEANING SURFACES

REFERENCE TO RELATED APPLICATION(s)

This application is the U.S. National Phase of PCT/EP2007/053540 filed on Apr. 12, 2007 and claims the benefit of U.S. Provisional Application No. 60/791,444 filed on Apr. 13, 2006.

The present invention relates to an aqueous composition comprising hydrogen peroxide and its use for cleaning surfaces.

Hydrogen peroxide-containing cleaning or disinfecting compositions are generally known. Thus U.S. Pat. No. 5,349,083 discloses an aqueous composition comprising a lower aliphatic peroxyacid (e.g. peracetic acid), prepared by combining hydrogen peroxide and a lower aliphatic acid.

WO 99/28427 discloses an aqueous bleaching composition comprising hydrogen peroxide, a polymeric thickener, a rheology stabilizing agent, and an alkalinity buffering agent. The pH of the compositions disclosed in the Examples is at least 7.

A method for cleaning a roof using an aqueous peroxide-containing cleaning composition is known from Australian Patent Application No. 2002100596. This document discloses a method for cleaning a roof which involves the steps of (i) placing an effective amount of a neutralizing agent on the lower part of the root (ii) applying an aqueous composition comprising a cleaning agent to the roof, and (iii) rinsing said composition from the roof with water, whereby the rinse water runs from the roof towards the neutralizing agent, so that residual cleaning agent is neutralized. Disclosed cleaning agents are hydrogen peroxide, percarbonates, preformed percarboxylic acids, persilicates, persulphates, perborates, organic and inorganic peroxides, and/or hydroperoxides. The cleaning composition also contains a surfactant.

It has now been found that such cleaning compositions can be further improved by the addition of an active thickener. An active thickener is a polymeric thickener capable of forming peroxy groups (e.g. peroxyacid groups) under acidic conditions and in the presence of hydrogen peroxide.

The aqueous composition according to the present invention has a pH of 3 or less and comprises the following ingredients, based on the total weight of the composition:

a) 0.0540 wt % of a polymeric thickener having —COOR groups, wherein R is independently chosen from H, OH, and a carbon-atom containing group, and
b) 0.05-60 wt % of hydrogen peroxide, wherein the active oxygen content attributable to ingredient a) is at least 0.02 wt %, based on the total weight of the composition, with the proviso that (co)polymers prepared from (meth)acrylate monomers are absent.

The aqueous composition in accordance with the invention comprises an active thickener comprising peroxy groups and having cleaning capabilities. An advantage of the active thickener is that it remains active over a longer period of time and is more effective specifically on the surface to be cleaned compared to conventional peroxyacids. The relatively low pH of the aqueous composition allows the composition to remain stable upon storage, i.e. gives a reduced loss of activity over time. The storage stability is particularly improved if the aqueous composition, and particularly the polymeric thickener, is essentially free of contaminants such as transition metals like copper, cobalt, iron, etc. If such transition metals are present, metal sequestering compounds can be added to the aqueous composition to provide a stable composition.

Additionally, the lower the pH, the more stable the peroxy acid functionality is in combination with the stabilizer mix prescribed.

In one embodiment of the invention, the aqueous composition has a pH of 3 or less and comprises the following ingredients, based on the total weight of the composition:

a) 0.05-20 wt % of a polymeric thickener having 20-100,000 monomeric units and on average containing at least 0.8 —COOR groups per monomeric unit, wherein R is independently chosen from H, OH, and a carbon atom-containing group,
b) 0.05-30 wt % of hydrogen peroxide, and
c) 0.5-60 wt % of one or more aliphatic carboxylic acids having 1 to 8 carbon atoms, their alkyl esters, anhydrides, and/or peroxyacids, wherein the active oxygen content attributable to ingredients a) and c) is at least 0.02 wt %, based on the total weight of the composition.

Due to the presence of the polymeric thickener (ingredient a), the cleaning composition according to the invention is more active in the cleaning of surfaces than comparable compositions that do not contain a thickener or that contain other thickeners.

Furthermore, the thickener reduces the composition's mobility, so that longer contact times with non-horizontal surfaces are possible. When cleaning a roof with the composition according to the invention, the composition has already been deactivated (i.e. has a lower active oxygen content and a higher pH) before it enters the environment. Hence, a separate neutralizing agent—as in the above-mentioned Australian Patent Application—is not required, meaning that the cleaning composition according to the invention is more environmentally friendly and allows a simpler cleaning procedure.

The polymeric thickener is present in the composition according to the invention in a concentration of at least 0.05 wt %, preferably at least 0.1 wt %, and more preferably at least 0.2 wt %. The maximum concentration is 20 wt %, preferably 10 wt %, and more preferably 2.5 wt %, all weight percentages based on the total weight of the composition. As one skilled in the art will recognise, the concentration of polymeric thickener in the composition also depends on the molecular weight of the thickener: the higher the molecular weight, the lower the preferred concentration.

The polymeric thickener typically has at least 20 monomeric units, preferably the thickener has 20-100,000, more preferably 100-75,000, and even more preferably 200-50,000 monomeric units.

In one embodiment the polymeric thickener contains, on average, at least 0.6 —COOR groups per monomer unit, preferably at least 0.7 —COOR groups per monomer unit, and most preferably at least 0.8 —COOR groups per monomer unit, wherein R is independently chosen from H, OH, or a carbon atom-containing group. In other words, the thickener contains carboxylic acid (R=H), peroxyacid (R=OH), and/or ester (K=carbon atom-containing group). The carbon atom-containing group can be any substituent comprising at least one carbon atom. Typically, the carbon atom-containing group is selected from the group consisting of alkyl, acyl, and aryl.

In at least part of the —COOR groups present in the thickener R is OH, indicating the formation of peroxyacid functionalities. It is noted that the —COOR groups may be present in the polymeric thickener already before addition to the aqueous composition, i.e. before contact with hydrogen peroxide, or may be formed after contact with hydrogen peroxide.

In this specification, the term "monomeric unit" does not refer to the repeating unit, but to the basic monomeric unit. For instance, in xanthan gum the repeating unit is a pentamer of five pyranose rings. The monomeric units, however, are the individual pyranose rings. Another example is that the monomeric units of carboxymethyl cellulose (CMC) are the individual glucose units.

In the context of the present application, "R is independently chosen" means that for each individual —COOR group in the polymeric thickener R is independently chosen.

The polymeric thickener can be any polymeric thickener comprising —COOR groups and which can form peroxy groups. The peroxidized polymeric thickener further has an active oxygen content of at least 0.02 wt %, based on the total weight of the composition. The inventors have observed that xanthan gum, which generally has 0.6 —COOR groups per monomer unit, does not form peroxy groups in an amount which is in accordance with the invention. Examples of suitable polymeric thickeners are homo-, co-, and terpolymers of carboxylic acids, functionalized cellulose, carboxymethyl cellulose, functionalized and/or crosslinked carboxymethyl cellulose, polyacrylates, polymethacrylates, functionalized polystyrene (SMA polymers), alpha methyl styrene polymaleic acids, functionalized EHEC, polyvinyl alcohol (PVA), PVP, and functionalized polyolefins and/or halogenated polyolefins.

The synthetic polymers obtained through addition polymerization, and in particular the (co)polymers prepared from (meth)acrylate monomers, are less preferred, as they are generally less biodegradable and burden the environment.

Also, these synthetic polymers are expensive. Moreover, peroxidized acrylate (co)polymers tend to separate and/or sediment from the aqueous composition.

In one embodiment of the invention, the polymeric thickener is selected from cellulose ethers, starches, and polyesters. Examples of such polymeric thickeners are carboxymethyl cellulose (CMC), and carboxymethyl starch.

It is also envisaged to use a combination of two or more of the above polymeric thickeners.

In a further embodiment, these thickened compositions can contain other inert thickeners to assist in adjustment of the viscosity without any negative effect on the cleaning ability of the composition.

The pH of the composition is 3 or less, preferably 1 to 3.

Because the pH of the aqueous composition is less than 3 and because the composition comprises hydrogen peroxide, an equilibrium is established between the carboxylic acid or ester functionalities and the peroxyacid functionalities in the thickener.

As a second ingredient (ingredient b), the composition according to the invention contains hydrogen peroxide. Hydrogen peroxide is present in the composition according to the invention in an amount of 0.05-30 wt %, preferably 1.5-20 wt %, calculated as $H_2O_2$ and based on the total weight of the aqueous composition.

As a third ingredient (ingredient c), the composition according to the present invention comprises at least 0.5 wt %, preferably at least 1 wt %, more preferably at least 4 wt %, and most preferably at least 7 wt % of one or more aliphatic carboxylic acids having 1 to 8 carbon atoms, the corresponding alkyl esters, anhydrides, and/or peroxyacids. The maximum amount of this third ingredient is 60 wt %, preferably 55 wt %, and most preferably 50 wt %, all based on the total weight of the composition.

In this specification, the term "aliphatic carboxylic acid" refers to carboxylic acids in which the carboxylic acid group (i.e. the —COOH group) is not directly attached to an aromatic ring. Although aromatic carboxylic acids—i.e. acids that have the carboxylic acid moiety directly attached to an aromatic ring (as in benzoic acid or dipicolinic acid)—may be present in the composition according to the invention as an additive, it is essential that the composition contains at least 0.5 wt % of an aliphatic carboxylic acid having 1 to 8 carbon atoms, its corresponding alkyl ester, anhydride, and/or peroxyacid.

The aliphatic carboxylic acid can be a mono-, di-, or tri-acid.

In one embodiment, the aliphatic carboxylic acid is a di-acid or a mixture of di-acids. In another embodiment the aliphatic carboxylic acid contains 3 to 8 carbon atoms.

Preferred aliphatic carboxylic acids are glutaric acid, succinic acid, adipic acid, citric acid, glycidic acid, hydroxy acetic acid, maleic acid, malonic acid, citraconic acid, fumaric acid, tartaric acid, valeric acid, butyric acid, itaconic acid, and mixtures thereof. More preferred are glutaric acid, a mixture of glutaric acid and citric acid, or a mixture comprising 40-60 wt % glutaric acid, 15-35 wt % adipic acid, and 15-30 wt % succinic acid. The advantage of glutaric acid is that it has good solubility, performance, and smell (it is odourless).

Aliphatic carboxylic acids that preferably should not be present in the composition according to the present invention are monochloropropionic acid (MCPP) and acetic acid. The former contains chlorine, which is undesired from an environmental point of view; the latter is undesired due to its irritating odour and its aggressive and volatile nature.

The alkyl ester of the aliphatic carboxylic acid having 1 to 8 carbon atoms preferably is a $C_1$-$C_5$ alkyl ester, more preferably a $C_1$-$C_3$ alkyl ester, and most preferably a methyl ester. Mono-, di-, and triesters can be used. Also monoesters of di- or tricarboxylic acids are suitable; the non-esterified carboxylic group(s) of such compounds may have an acid, anhydride, or peroxyacid functionality.

In the presence of hydrogen peroxide (ingredient b), the carboxylic acid, its anhydride and/or alkyl ester will be in equilibrium with the corresponding peroxyacid. The amount of peroxyacid present in the composition attributable to ingredient c) preferably is at least 0.5 wt %, more preferably at least 1 wt %, and most preferably at least 2 wt %. The maximum amount of peroxyacid attributable to ingredient c) preferably is 20 wt %, more preferably 10 wt %, and most preferably 5 wt %, all based on the total weight of the aqueous composition.

In an embodiment that is preferred from an economical point of view, ingredient c) comprises a mixture of the monoperoxyacids of the monoalkyl esters of glutaric acid, succinic acid, and/or adipic acid. More preferably, it comprises a mixture of the monoperoxyacids of the monomethyl esters of glutaric acid, succinic acid, and/or adipic acid. Even more preferred are mixtures of the monoperoxyacids of the monomethyl esters of glutaric acid, succinic acid, and adipic acid in the respective amounts (based on the total weight of ingredient c) of 40-60 wt %, 15-30 wt %, and 15-35 wt %.

The active oxygen content attributable to the peroxy functionalities in ingredients a) and c) is, in sum, at least 0.02 wt %, preferably at least 0.05 wt %, and most preferably at least 0.1 wt %. The total active oxygen content of the composition according to the invention preferably is at least 1 wt %, more preferably 1-25 wt %, and most preferably 2-9 wt %. The active oxygen content is determined by the method described in the Examples and is based on the total weight of the composition.

Optionally, the composition according to the present invention may comprise an additional Brønsted acid, e.g. an inorganic acid such as $H_2SO_4$, $H_3PO_4$, or $H_3PO_3$. This acid catalyzes the formation of peroxyacid functionalities in the thickener and the carboxylic acid, its anhydride or alkyl ester and serves to quickly establish the equilibrium. It also serves to stabilize the composition and to maintain the required pH at 3 or less.

This acid is preferably present in the composition in an amount of 0.01-2 wt %, more preferably 0.02-0.5 wt %, based on the total weight of the composition.

The water content of the composition according to the invention preferably is in the range of 30 to 90 wt %, more preferably 35 to 85 wt %, most preferably 40 to 80 wt %.

Additional components that may be present in the composition according to the invention include stabilizers, such as dipicolinic acid, alkyl phosphates, alkyl phosphonates, aminophosphates (e.g. Dequest®), amino carboxylates (e.g. NTA, EDTA, PDTA), and di- or polycarboxylates (e.g. polycitric acid, polyacrylate, or styrene maleic acid copolymers). A stabilizer is preferably present in a concentration of 10-20,000 ppm, more preferably 100-15,000 ppm, and most preferably 200-10,000 ppm (depending on the quality of the starting raw materials). Also surfactants (e.g. cationics, nonionics, and anionics derived from long chain fatty acids or alcohols), chelating agents, or water-soluble alcohols (e.g. methanol, ethanol, propanol, glycols, glycerine) may be present in the composition. It is emphasized that, although surfactants and chelating agents may be present in the composition, their presence is not required.

Further, the composition according to the invention may contain one or more additional thickeners in order to enhance the viscosity and improve the viscosity stability and lead to a longer contact time between the composition and the surface to be cleaned. Examples of additional thickeners are xanthan gum, clays, inorganic nanoparticles (including naturally occurring clays), and/or functionalized inorganic nanoparticles.

For stability reasons, the metal content—in particular the content of Cu, Co, Fe, Ce, Mn, V, Cr, or Ni—of the composition according to the invention preferably is less than 1 ppm, more preferably less than 0.5 ppm (calculated as metal and based on the weight of the total composition).

The composition according to the present invention preferably has the form of a clear aqueous solution.

Preferably, the composition according to the invention is sprayable. Typically, "sprayable" means that the Brookfield viscosity of the composition at its temperature of use preferably is not higher than 6,000 cps. However, it is also envisaged to use equipment suitable for spraying compositions having a Brookfield viscosity above 6,000 cps. Alternatively, aqueous compositions exhibiting shear thinning behaviour may have a Brookfield viscosity exceeding 6,000 cps.

Preferably, the Brookfield viscosity of the aqueous composition of the invention is in the range of 0.1-6,000 cps, more preferably 20-2,000 cps, even more preferably 50-1,000 cps, and most preferably 50-750 cps.

The composition according to the invention can be prepared by mixing an aqueous hydrogen peroxide solution (e.g. a 70% $H_2O_2$ solution) with (i) the polymeric thickener, and (ii) optionally additional water and/or additional ingredients. Preferably, the polymeric thickener is pre-dissolved in water to create a composition sufficiently viscous and homogenized. The hydrogen peroxide is then added to this system to create the aqueous composition of the invention.

In another embodiment of the invention, the aqueous composition can be prepared by mixing an aqueous hydrogen peroxide solution (e.g. a 70% $H_2O_2$ solution) with (i) the polymeric thickener, (ii) at least one aliphatic carboxylic acid having 1-8 carbons atoms, its alkyl ester, anhydride, or mixed anhydride, and (iii) optionally additional water and/or additional ingredients. An example of a suitable mixed anhydride is the mixed anhydride formed by reacting glutaric anhydride and citric acid.

The ingredients may be added in any order of addition. On an industrial scale, safety might require that the hydrogen peroxide be added as the last compound. In another embodiment, the polymeric thickener and the hydrogen peroxide are mixed together before being added to the carboxylic acid having 1 to 8 carbon atoms, its alkyl ester, or (mixed) anhydride. This allows better dissolution of the thickener and accelerates peroxyacid formation.

In order to enhance (i) the rate at which the composition reaches equilibrium, (ii) its sprayability, and/or (iii) its cleaning performance, the aqueous composition according to the invention may be heated during its preparation, storage, transport, and/or application. It is preferably heated to a temperature in the range of 25-70° C., more preferably 35-70° C., and most preferably 40-60° C.

The composition according to the invention is particularly suitable for the cleaning of surfaces, both porous and non-porous, both indoor and outdoor, and both horizontal and non-horizontal. Types of surfaces that can be cleaned with the composition of the invention include stone (e.g. bricks), concrete, plaster, plasterboard, glass, asphalt, natural or synthetic polymeric materials (elastomers, thermoplasts, thermosets), metals, ceramics (glazed or non-glazed), asbestos, (aged) wood (hard, soft, or synthetic), coated surfaces, and enamel surfaces, and fabrics (synthetic or natural).

The composition is particularly suitable for the cleaning of exterior (porous) surfaces, such as roofs, facades of buildings, fences, and paving.

The composition according to the invention makes cleaning of surfaces very easy, because the only action required is applying, e.g. spraying, the composition onto the surface. Brushing or other mechanical treatments are optional.

If desired, the composition may be removed from the surface. It can be removed actively, for instance by rinsing with water. However, in the case of exterior surfaces, removal can be simply performed by nature, e.g. by exposing the surface to rain and/or wind.

For optimum effect, it is recommended to wait at least one hour, more preferably at least three hours, between the application of the composition on and its removal from the surface.

With the composition according to the invention, both chemical and bio fouling can be removed from surfaces.

Depending on the formulation of the composition, the nature of the surface, and the amount and nature of the fouling, the composition according to the invention is preferably applied to the surface in an amount of 100-500 ml/m$^2$. If necessary, multiple treatments can be applied.

In addition, it should be noted that the composition according to the invention may also be used as a bleaching agent, e.g. for textiles or paper.

EXAMPLES a) Measurement of the Total Active Oxygen Content ("AO")

The active oxygen content was measured by placing 20 ml of glacial acetic acid in a 200 ml conical flask fitted with a ground glass joint and an inlet tube for nitrogen gas. Nitrogen gas was then passed over the surface of the liquid. After 2 minutes, 4 ml of 770 g/l potassium iodide solution was added and a sample containing approximately 1.5 meq of active oxygen was added to the reaction mixture with mixing. The reaction mixture was allowed to stand for at least 10 minutes at 25° C.±5° C.

Demineralized water (50 ml) was then added, followed by 3 ml of a 5 g/l starch solution. The reaction mixture was then titrated with a 0.1 N sodium thiosulphate solution to a colourless end point. A blank should be run alongside this titration. The active oxygen content, in wt %, was then calculated by subtracting the volume in ml of sodium thiosulphate solution used in the blank from the amount used in the titration, multiplying this value by the normality of the sodium thiosulphate solution and then by 800, and finally dividing by the mass of the peroxide sample in milligrams.

b) Potentiometric Measurement of the Peroxyacids Concentration and the Active Oxygen Content Attributable to Peroxyacids Weigh 0.1 to 5 g peroxide sample and charge it into a 150 ml beaker. Add 100 ml demi-water and titrate it with a 0.1N potassium hydroxide solution in ethanol, using a potentiometric titrator with automatic endpoint detection, equipped with a combined glass calomel electrode (3M KCl in water).

Two potential jumps are observed, the first from the organic acid (=$V_1$) and the second from the peroxyacid (=$V_2$).

The peroxyacid functionality content of both the thickener and the carboxylic acid containing 1 to 8 carbon atoms (in wt %) is calculated by subtracting $V_1$ from $V_2$ and multiplying this figure by the normality of the potassium hydroxide solution and then by the average molar mass of the percarboxylic acid and the monomeric units of the peroxidized thickener, and finally dividing it by 10 times the mass of the sample in grams. The result is in wt % peroxyacid.

The AO content attributable to peroxyacid groups is achieved by multiplying the wt % found above by 16 and finally dividing it by the molar mass of the peroxide involved. Free $H_2O_2$ does not influence the data generated by this method.

In the Examples below, the total active oxygen content of the composition was measured as above (method (a)), the active oxygen content attributable to the peroxyacid groups of both the carboxylic acid having 1-8 carbon atoms and the polymeric thickener was determined using method (b), and the active oxygen content attributable to $H_2O_2$ was determined by subtracting the active oxygen content attributable to the peroxyacids (method (b)) from the total active oxygen content (method (a)).

Example 1

The following compounds were mixed in a two-litre beaker: 713.4 g water, 155.4 g of a 70% $H_2O_2$ solution, 0.70 g Dequest® 2010 (an aqueous solution of 1-hydroxyethylidene-1,1-diphosphonic acid ex Solutia) and 0.40 g 2,6-pyridine dicarboxylic acid (dipicolinic acid). The resulting mixture was heated to 32° C. while stirring. Then 5.0 g of CMC (Akucell AF 0305 ex Akzo Nobel): a food grade carboxymethyl cellulose with an average number of monomeric units of approx. 2,000 and an average amount of —COOR groups per monomeric unit in the range of 0.8-1.2) were added and the mixture was homogenized by stirring for another 30 minutes. Next, 165.49 glutaric acid were added, followed after 5 minutes by 2.31 g of a 96% $H_2SO_4$ solution. The mixture was stirred for 60 min at 32° C. and filtered through a glass filter (size G-2), yielding a clear, colourless solution. The mixture was then stored for 4 days at 30° C.

The resulting solution had a pH of 1. Its composition and active oxygen (AO) content are indicated in Table 1. The formation of peroxyacid functionalities in the CMC was confirmed by spectroscopic analysis.

Example 2

In a two-litre beaker, 681.7 g water were heated to 50° C. 10.64 g CMC (5.32 g Akucell® AF 0305 and 5.32 g Akucell® AF 3275) were added slowly under stirring at 250 rpm. The CMC had an average amount of —COOR groups per monomeric unit in the range of 0.8-1.2. Stirring was continued at 1,000 rpm for 15 minutes. Full homogenization was attained. Dimethyl glutarate (187.9 g) was then added, the mixture was cooled down to 20° C., and dipicolinic acid (0.41 g) and Dequest® 2010 (0.85 g) were added. Next, 13.8 g of a 20 wt % sulphuric acid solution were added under stirring, resulting in a decrease of the pH from 4.54 to 1.70.

The obtained mixture was heated at 40° C. and 148.9 g of a 70% $H_2O_2$ solution were added. The mixture was stirred for an additional 165 minutes at 40° C., The mixture was cooled down to 20° C. and stored for 11 days. Its composition and active oxygen content are listed in Table 1.

Comparative Example 3

A solution according to Example 1 was prepared, except that the CMC was replaced by 5.0 g of xanthan gum (Rhodopol® 23). Xanthan gum contains, on average, 0.6 —COOR groups per monomeric unit.

The resulting solution had a pH of 1. Its composition and active oxygen content are indicated in Table 1.

Comparative Example 4

The following compounds were mixed in a 25-litre vessel: 6,993.6 g water, 1,489.0 g of a 70% $H_2O_2$ solution, 1,612.6 g glutaric acid, 4.07 g dipicolinic acid, 6.62 g Dequest® 2010, and 20.05 g of a 96% $H_2SO_4$ solution. The mixture was swirled for a few minutes, whereby the temperature rose adiabatically to 24° C. The mixture was stored for 5 days at 20° C. in order to reach equilibrium.

The resulting solution had a pH of 1. Its composition and active oxygen content are indicated in Table 1.

Comparative Example 5

Comparative Example 4 was repeated, except that no glutaric acid was added. The active oxygen content is indicated in Table 1. No peroxyacids were detected.

TABLE 1

| | Ex. 1 | Ex. 2 | Comp. Ex. 3 | Comp. Ex. 4 | Comp. Ex. 5 |
|---|---|---|---|---|---|
| Type of thickener | CMC | CMC | xanthan gum | — | — |
| Amount of thickener (wt %) | 0.5 | 1.0 | 0.5 | — | — |
| Glutaric acid (wt %) | 16 | 18 | 16 | 16 | 0 |
| $H_2O_2$ (wt %) | 10 | 10 | 10 | 10 | 12 |
| Total AO (wt %) | 5.0 | 5.0 | 5.0 | 5.0 | 4.70 |
| AO from thickener and perglutaric acid (wt %) | 0.4 | 0.1 | 0.4 | 0.4 | — |

Example 6

The samples of Example 1 and Comparative Examples 3 and 4 were tested as cleaning agents for china surfaces according to the following method.

Tea was prepared by adding 2 litres of boiling water to 30 grams of Ceylon black tea. After standing for 5 minutes, the tea was filtered. To the filtrate, 0.1 ml of an aqueous iron sulphate solution (containing 5 g iron sulphate and 1 ml 37% HCl per litre) was added in order to darken any tea stains.

A 180 ml tea cup was filled with 100 ml of the resulting tea mixture. The temperature of the mixture in the tea cup was 85° C. After 5 minutes, the tea mixture was removed from the cup using a pipette. The same cup was then again filled with the tea mixture, which was again removed with a pipette after 5 minutes. After 24 hours standing at room temperature, the now stained tea cup was sprayed with 2 grams of the solution according to one of the above-mentioned Examples. After 5 minutes, the cup was rinsed by being filled slowly with 175 ml of water at 30° C., being left for 15 s, and then being emptied. The cups were evaluated for tea stains immediately. The results are listed in Table 2.

The test shows that the composition according to the invention (Example 1) has a better cleaning performance than the composition with another type of thickener (Comp. Example 3) or no thickener at all (Comp. Example 4). The latter showed only very limited cleaning performance.

TABLE 2

| | Test results [1] |
|---|---|
| Example 1 | **** |
| Comp. Example 3 | *** |
| Comp. Example 4 | * |

[1] * = poor cleaning performance/**** = good cleaning performance

Reference Examples 7-10

A series of preparations was made to establish the degree of peroxidation of the thickening agents that can be achieved using the above-described manufacturing procedures. The compositions prepared do not contain ingredient c), i.e. the aliphatic carboxylic acid, its anhydride, alkyl ester, or peroxyacid. The following compounds were prepared:

Reference Example 7

To 356.7 g of demineralized water, 77.7 g $H_2O_2$-70%, 0.35 g Dequest® 2010, and 0.20 g dipicolinic acid were added with stirring. The mixture was heated to 33° C. Additionally, 3.75 g of CMC (Akucell AF 0305 ex Akzo Nobel) were solubilized over a period of about 60 min. Then, 1.16 g $H_2SO_4$-96% were added and the mixture was stirred at 33° C. for another 120 min. The resulting mixture was filtered over a G-2 filter to remove traces of insoluble CMC. The mixture was then stored in an oven at 35° C. for 4 days. pH after storage: 1.2.

The AO associated with the peroxyacid groups formed from the reaction of hydrogen peroxide with the CMC was analyzed to be 0.3 wt %. Additionally, on aging for one week the concentration of AO associated with these chemical species rose to a level of 0.8 wt %.

Reference Example 8

To 356.7 g demineralized water, 77.7 g $H_2O_2$-70%, 0.35 g Dequest® 2010, and 0.20 g dipicolinic acid were added with stirring. The mixture was heated to 33° C. Additionally, 3.75 g of xanthan gum (Rhodopol® 23) were solubilized into the mixture over a period of about 60 min. Then, 1.16 g $H_2SO_4$-96% were added and the mixture was stirred at 33° C. for another 60 min. After standing overnight (under slow stirring using a magnetic stirrer) the mixture was filtered and stored in an oven at 35° C. for 4 days. pH after storage: 1.2.

Although a very small amount of AO associated with the peroxyacid groups formed from reaction of the hydrogen peroxide with the xanthan gum is present, it is below the minimum level of detection to accurately quantify.

Reference Example 9

To 356.7 g demineralized water, 77.7 g $H_2O_2$-70%, 0.35 g Dequest® 2010, and 0.20 g dipicolinic acid were added with stirring. The mixture was heated to 33° C. Additionally, 3.75 g of CMC (Akucell AF 0305 ex Akzo Nobel) were solubilized into the solution over a period of about 60 min. Then the mixture was stirred at 33° C. for another 60 min, then slowly agitated using a magnetic stirrer bar overnight. The so obtained homogeneous mixture was then stored in an oven at 35° C. for 4 days.

The AO associated with peroxyacid groups formed from the reaction of hydrogen peroxide with the thickener was measured to be 0.3 wt %

Reference Example 10

To 356.7 g water, 0.35 g Dequest® 2010, and 0.20 g dipicolinic acid were added with stirring. The mixture was heated to 33° C. Additionally, 7.5 g of CMC (Food grade, ex Akzo Nobel) were solubilized into the solution over a period of about 45 min. Then the mixture was stirred overnight using a magnetic stirrer bar. The so obtained homogeneous mixture was then analyzed for peroxyacid content. No peroxyacid groups were present in the sample.

The compositions according to Reference Examples 7-10 were analyzed for their total active oxygen content and peroxyacid assay, using the methods described above. The samples were stored for 4 days at 35° C. before analysis. The results of the analysis are shown in Table 3.

The results of the analysis indicate that the polymeric thickeners are able to form peroxyacid groups. The composition of Reference Example 7 was also analyzed upon prolonged storage at room temperature. The analytical data indicate that the peroxyacid content increases upon storage.

TABLE 3

| Ref. Example | Thickener | Inorganic acid | Time | Total AO (wt %) | AO attributable to peroxyacids (wt %) |
|---|---|---|---|---|---|
| 7 | CMC | $H_2SO_4$ | After preparation | 5.90 | 0.3 |
| 7 | CMC | $H_2SO_4$ | After 4 weeks ambient storage | 5.88 | 0.8 |
| 8 | Xanthan gum | $H_2SO_4$ | After preparation | 5.89 | Not detectable |
| 9 | CMC | none | After Preparation | 5.94 | 0.3 |
| 10 | CMC | none | After preparation | 0 | Not detectable |

The invention claimed is:

1. An aqueous composition having a pH of 3 or less and comprising the following ingredients, based on the total weight of the composition:

a) 0.05-20 wt % of a polymeric thickener having 20-100,000 monomeric units and on average containing at least 0.8 —COOR groups per monomeric unit, wherein R is independently chosen from H, OH, and a carbon-containing group, b) 0.05-30 wt % of hydrogen peroxide, and c) 0.5-60 wt % of one or more aliphatic carboxylic acids having 1 to 8 carbon atoms, their alkyl esters, anhydrides, and/or peroxyacids, wherein the active oxygen content attributable to ingredients a) and c) is at least 0.02 wt %, based on the total weight of the composition.

2. The aqueous composition according to claim 1 wherein the active oxygen content attributable to ingredients a) and c) is at least 0.1 wt %, based on the total weight of the composition.

3. The aqueous composition according to claim 1 wherein the one or more aliphatic carboxylic acids are selected from glutaric acid, succinic acid, adipic acid, citric acid, glycidic acid, hydroxy acetic acid, maleic acid, malonic acid, citraconic acid, fumaric acid, tartaric acid, valeric acid, butyric acid, and itaconic acid.

4. The aqueous composition according to claim 3 wherein ingredient c) comprises a mixture of the monoperoxyacids of the monoalkyl esters of glutaric acid, succinic acid, and/or adipic acid.

5. The aqueous composition according to claim 1 wherein ingredient c) is present in a total amount of 7-40 wt %.

6. The aqueous composition according to claim 1 further comprising 0.01-2 wt % of an inorganic acid.

7. The aqueous composition according to claim 2 wherein the polymeric thickener is present in an amount of 0.2-2.5 wt %.

8. The aqueous composition according to claim 4 wherein ingredient c) is present in a total amount of 7-40 wt %.

9. A process for cleaning a surface, the process comprising applying the aqueous composition according to claim 1 to said surface.

10. The process according to claim 9 wherein the aqueous composition, when applied to the surface, has a temperature of 25-70° C.

* * * * *